United States Patent [19]

Gilbert, Sr

[11] Patent Number: 4,753,017

[45] Date of Patent: Jun. 28, 1988

[54] HEAT CONTROL OF STEAM-HEATED ROLLERS

[76] Inventor: Lyman F. Gilbert, Sr, 1850 S. Second Ave., Arcadia, Calif. 91006

[21] Appl. No.: 28,239

[22] Filed: Mar. 23, 1987

[51] Int. Cl.[4] ..... F26B 19/00

[52] U.S. Cl. ..... 34/48; 34/119; 165/40

[58] Field of Search ..... 236/17, 18, 19, 94; 165/40; 374/31, 40, 41, 42; 237/67; 34/119, 124, 125, 48

[56] References Cited

U.S. PATENT DOCUMENTS

| | | | |
|---|---|---|---|
| 3,748,224 | 7/1973 | Tillie et al. | 34/48 X |
| 4,222,178 | 9/1980 | Moran | 34/48 X |
| 4,447,964 | 5/1984 | Gardner | 34/119 X |
| 4,493,158 | 1/1985 | Van Os | 34/48 X |
| 4,499,668 | 2/1985 | Jumpeter | 34/119 X |

*Primary Examiner*—Harry B. Tanner

*Attorney, Agent, or Firm*—Donald D. Mon

[57] ABSTRACT

A system to maintain the BTU output of a rotary drum, in which steam is supplied to the drum, and in which saturated steam and condensate is drained therefrom. An upstream flow meter and a downstream flow meter measure fluid flow, and in view of the small partial pressure of the condensate and of the large volumetric difference between the condensate and the steam which was condensed, the difference between the flow meter readings can be understood as a measure of BTU's provided as a consequence of the condensation which occurs in the drum.

7 Claims, 1 Drawing Sheet

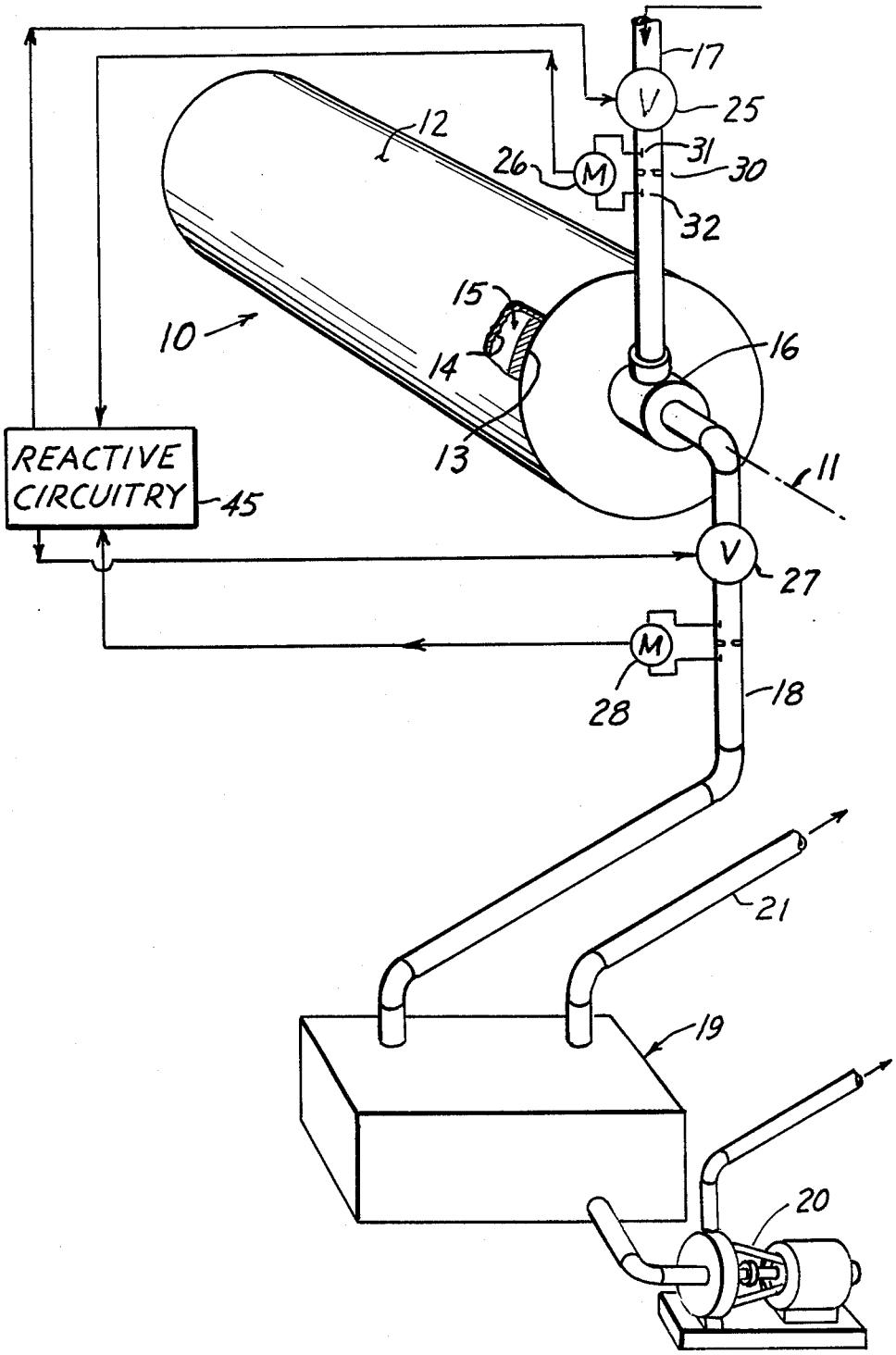
17
V
25
12
26
M
31
30
32
15
10
14
16
13
11
REACTIVE CIRCUITRY
45
V
27
M
28
18
21
19
20

HEAT CONTROL OF STEAM-HEATED ROLLERS

FIELD OF THE INVENTION

This invention relates to the heat control of steam-heated rollers of the type generally used in paper mills to remove water from the product produced from wet pulp.

BACKGROUND OF THE INVENTION

This invention relates to control of the fluid drain and thence the temperature of steam-heated rollers. Especially but not exclusively in paper mills, a wet pulp is laid on a web and then is run over the surface of successive heated rollers to remove the water and to produce paper as a product. The flow of the pulp which is to become paper is very swift, and its path length through the machine is very long. Path velocities on the order of 35 miles per hour, widths of 24 feet or more, and roller diameters of five feet or larger are commonplace. The rollers are hollow drums to which steam is supplied, and from which condensate and steam are removed. In accordance with good thermodynamic practice, steam discharged from one roller is supplied to the next roller, often in a sequence of perhaps five rollers in a group.

The system is very massive. The mass transport is very large. In the event of failure such as breakage of the treated material or the failure of a roller or a group of rollers to perform their intended function, wastage of many tons occurs before the system can be shut down.

Paper mills are huge installations, and their capital investment is very great. A new paper mill can be expected to cost on the order of $800 million, and an older used mill, perhaps $350 million. Even these large costs do not reflect the total situation. The heavy wear to which they are subjected gives rise to a rebuilding cycle on the order of only about five years. Each five years the average paper machine will be shut in for a substantial period of time during which it is refurbished to operational standards, and at the same time is modernized to provide such advantages as may have become available since its last rebuilding.

The burden of the foregoing is that the costs of inefficiencies in these plants are literally immense. At the present time, in many paper mills that are regarded as in suitable condition, losses by way of unacceptable products approach 5% of the daily throughput. In a 1,000 ton per day mill, this amounts to 50 tons. This tonnage has consumed energy needed to drive the mill and to heat the product. Even though the scrap can be recycled, the labor and thermal energy are not recoverable. As a consequence, designers and operators of these mills are constantly alert for opportunities to reduce the generation of scrap, and to reduce the energy requirements. In fact, there are designers and rebuilders whose entire careers are occupied by redesign, improvement and refurbishment of paper mills with these objectives in mind.

What is genuinely surprising is the fact that in even the most advanced mill presently known to the inventor, control over the running conditions of the steam-heated rolls can still be improved so as to reduce the quantity of scrap produced by the mill. For example, with presently known controls, there is a substantial and continuing risk that the dryer roll may be flooded with hot water. The water greatly inhibits the heat transfer to the paper product. The present state of the art uses pressure drop across the dryer roll drain mechanism as the control reference. This is inadequate because some dryer rolls may be flooded, while adjacent dryer rolls are blowing steam through uncontrolled. Measurement of the supply steam and also of the drain steam as proposed by the instant invention provides BTU measurements needed properly to treat the paper.

At present the detection of a flooded dryer roll (which will not provide the proper drying conditions) is actually a happenstance thing. Periodically an inspector uses an infrared detector which he aims at the dryer roller to measure its temperature. He stands at a considerable distance from the roller and aims at a given spot on the rapidly rotating dryer roller. Assuming good aim and optimum conditions, a dryer roller at the wrong temperature will indeed be detected. But by the time a drop in temperature is detected, the dryer roller will be flooded with water. This causes off-specification paper to be produced that usually must be recycled with a loss of labor and energy.

However, even these proposed and imperfect results are rarely attained in mills of this type. This is because these mills are hot, humid, noisy, and very distracting places. As a consequence, a roller which is performing improperly is seldom discovered until the paper is not properly dried (scrap) or an associated large drive motor starts to overload. Meanwhile, as a precaution the entire system is often adjusted to dry the paper excessively so as to be certain the product is dried acceptably. This consumes excess energy, and can also lead to reduced production of paper.

The costs of these adverse circumstances are substantial. In a large mill, the costs of excess energy consumed but not truly needed can readily approximate $10,000 per day. The accurate control of roller conditions is, as can be seen, an objective long recognized by any prudent paper mill designer or operator.

Mills which utilize so many and such large rollers inherently must consume great amounts of energy, and for the intended applications the optimum source is steam. The properties of steam are well established, and it would seem to be a simple problem in thermodynamics to maintain the rollers in their correct condition both individually and as one of a sequence of rollers. The inefficiency of existing plants shows instead that it is not a simple matter after all, because after generations of good engineers have done their best (and produced large amounts of paper products), the problems and wastage continue to exist.

Surprisingly, the regulation of roller temperatures under the prevailing conditions by means of fluid flow measurements has not been done before, and by means of this invention, which utilizes this approach, the machines can reliably be regulated to assure that the individual rollers are indeed maintained at a proper temperature, with a proper BTU throughput.

It is an object of this invention to provide a rugged and reliable measurement and control which frustrates the flooding of a roller, or the converse, excess steam blow through, and which maintains throughput and temperature conditions to maintain a predetermined temperature while supplying the correct caloric output necessary to heat the paper while it resides on the rollers.

Importantly, this invention enables these results to be attained with the use of elegantly simple controls and minimized plumbing.

BRIEF DESCRIPTION OF THE INVENTION

This invention provides a supply steam flow meter upstream in the steam flow entering the dryer roll and a drain steam flow meter downstream in the steam flow leaving the dryer roll. Saturated steam (which may instead occasionally be superheated steam) is supplied to the inlet at an elevated pressure which by definition establishes the roller temperature. Valves upstream and downstream are set to establish flow conditions that conform to the desired flow-through of steam and condensate at the drain as the consequence of an enabling measurement made with the use of the two flow measurements from the flow meters. The differential conditions between the two flow meters reflect the fact that caloric output to the pulp stream through the roller causes condensation of some of the steam in the roller. The very substantial difference between the volume of the steam that is condensed, and the volume of the resulting condensate, enables one to calculate supply and drain steam flow, change of state, and the energy (BTU's/calories) absorbed by the product, and to adjust the mass throughput so that flooding does not occur. A functional and efficient system is thereby enabled.

The above and other features of this invention will be fully understood from the following detailed description and the accompanying drawings, in which:

BRIEF DESCRIPTION OF THE DRAWINGS

The figure is a schematic illustration of the presently preferred embodiment of the invention.

DETAILED DESCRIPTION OF THE INVENTION

In the figure there is shown a steam heated roller 10 (sometimes called a "rotary drum", having an axis of rotation 11, an exterior cylindrical contact surface 12, and end plates 13. The roller is hollow, the contact surface being formed on a wall 14 of uniform thickness which is exposed to steam in the interior of the roller. Cylindrical cavity 15 (sometimes called a "steam chamber"), defined by wall 14 and end plates 13 receives steam.

A bearing (not shown) at one end, and a rotary joint 16 at the other end, support the roller for rotation around the axis. Drive means (not shown) drives the roller so it maintains a tangential velocity equal to the linear velocity of the paper product. The objective, of course, is to enable the paper product, in whatever state of water removal, to be in contact with surface 12 for a suitable period of time during which some of the water in the product is evaporated from it. The term "product" is not limited to the finally completed paper, but is intended to include its condition throughout the process, including the pulp in all of its stages.

A steam supply line 17 supplies steam to the cavity in the roller, and a drain line 18 removes condensate and residual steam from the roller. The wall of the roller is heat conductive, usually made of steel, and evaporation of water from the paper product and losses by emission result in condensation of some of the steam in the roller. The drain line includes conventional means (not shown) inside the roller which have feet or other evacuation devices to remove the condensate from the wall, and also to drain excess steam from the roller. These provisions are completely conventional and are therefore not disclosed in detail.

The drain line discharges to a collection box 19 from which condensate may be removed by a pump 20 which recycles the water. A downstream supply line 21 conveys drain steam to the next roller downstream.

This invention exercises surveillance and control over the conditions in the steam line and in the drain line. This is accomplished by providing an adjustable steam supply control valve 25 and a steam supply flow meter 26 in the supply line, and an adjustable drain control valve 27 and drain flow meter 28 in the drain line. The theory of the function of this system is based on the fact that steam throughout the system is saturataed (occasionally superheated). Therefore its temperature will be known from its pressure. The control valves, along with the usual steam controls regularly provided in any suitabiy designed system enable one to establish this pressure.

The objective of this system is to provide a predetermined BTU output through the wall of the roller. If there is an insufficient flow of steam, then soon the caloric drain will condense steam to an amount of water which will not be drained, and the roller will fill with hot water. A water-filled roller cannot produce the BTU's required. Furthermore, its mass greatly increases the load on its driving motor. Incorrect product is likely to be produced, and the overload on the drive system can lead to bearing overloads and ultimate damage to the motors.

On the other hand, too great a steam flow is likely to overdry the product, and definitely wastes energy. Clearly, a properly balanced system will provide the correct caloric output to the surface of the roller, but no more, and in so doing should be in steady flow with a roller essentially filled with steam, and with condensate withdrawn at its rate of formation.

The control valves may be any suitable adjustable steam valve such as a globe valve or a gate valve, automatically or manually operated.

The flow meters are conventional differential flow meters as described in the ASME Report on Fluid Meters, 6th edition. They operate to measure flow as a function of the differential pressure set up across an a primary element 30 such as an orifice, a nozzle, or a venturi, or the like, measured by an upstream sensor 31 and a downstream sensor 32. These flow meters are quite standard and require no detailed description here. Meters 26 and 28 are identical.

It will be observed that the flow through the steam supply flow meter 26 is entirely gaseous (it could be slightly superheated) steam. The fluid flow through drain flow meter 28 is a mixture of saturated steam and condensate. Because they both pass through the drain flow meter, the condensate will constitute a small offset to the actual drain steam flow measurement. In fact the reading will be higher than if the same amount of steam were passed through the flow meter, without the condensate. The error is small, in large part because of the substantial difference in volume of a given weight of condensate water, and of steam. This invention essentially measures the flow rate of the drain steam and compensates for the liquid phase.

In a practical system, the resulting "offset" will be about 7%, but most importantly, this offset is substantially constant from full loads through the entire range of partial loads. Therefore, knowing the offset, this simple control concept can be used with full confidence. This is an important feature, because it is unnecessary to provide means to separate the condensate from the steam ahead of the drain flow meter. To do so would require substantial piping and other features which would uneconomically enlarge both the cost and the bulk of the installation.

In operation the BTU output can be derived from the difference between the readings for the supply steam flow and for the drain steam flow. Their difference, read in weight per unit of time, gives the weight of condensate, and from a knowledge of the temperatures and pressures, the BTU provided to the roller can be calculated, again bearing in mind the inherent but constant instrument offset.

Much more to the point is that, once there is established a ratio of the two flow meter readings that results in a suitable BTU output, it is possible to monitor this ratio to assure that the desired steady state persists. Thus, reactive circuitry 45 can be connected between the two flow meters, and so long as the ratio remains within predetermined limits, the operation is acceptable.

In the event that the roller tended to flood, it would reflect insufficient drain steam flow through to meet the demands of the paper. A greatly decreased steam flow rate tnrough the drain flow meter would be registered, and this operating error could quickly be observed and corrected by adjusting the valves either manually or in response to the reactive circuitry. An excessive rate could also be observed and corrected.

This arrangement enables each roller in groups of many rollers to be monitored and controlled. Thus, a temperature profiled system can be arranged, requiring no more than valves which are always provided in the system anyway, and two conventional flow meters for each roller.

Any type of flow meter which is capable of responding to the flow of steam is useful in this invention. Preferably the meter will be the type which responds to a differential pressure, and may be considered a differential meter. These have primary elements which develop the differential pressure to be sensed. Examples of such primary elements are orifice plates, venturis, and nozzles. Flow meters utilizing these features are well known and require no detailed description here.

Underlying the operation of this system is the fact that the partial pressure of the condensate water at the flow meter is quite low, especially compared to the partial pressure of the steam phase. Thus, the offset that results from measuring the flow of a mixed phase stream is itself low enough to be tolerated in creating an effective control system.

This invention thereby provides a reliable, rugged and relatively inexpensive system to assure the operating conditions of steam heated rollers.

This invention is not to be limited by the embodiment shown in the drawings and described in the description, which is given by way of example and not of limitation, but only in accordance with the scope of the appended claims.

I claim:

1. In a system to monitor the BTU output of a rotary drum which has an inside steam chamber and an outer wall heated by steam supplied to said chamber; a supply steam line connected to said drum to supply steam to said chamber; a drain steam line connected to said drum to drain steam and condensate from said chamber; an adjustable supply valve in said supply line, and an adjustable drain valve in said drain line, the improvement comprising:

a supply flow meter in said supply line and a drain flow meter in said drain line, each flow meter measuring the flow of fluid therethrough established by its respective flow valve, the fluid measured by said drain flow meter comprising both steam and condensate water, said measurements enabling calculation; as a function of the difference between the measurements of the flow meters, with compensation for the offset to the reading of the drain flow meter caused by the presence of condensate, of the BTU provided to said outer wall; thereby enabling the maintenance of a substantially constant and desired BTU throughput to the said drum by adjustment of said valves.

2. A system according to claim 1 in which reactive circuitry is provided to receive and compare the measurements by the two flow meters and to adjust the settings of at least one of the valves as necessary to maintain a preselected BTU rate throughout as a function of the observed and compensated steam flow readings.

3. A system according to claim 1 in which each said flow meter comprises a primary element in the respective line, and a pressure sensor upstream from and downstream from its said primary element.

4. A system according to claim 3 in which said primary element is an orifice.

5. A system according to claim 3 in which said primary element is a nozzle.

6. A system according to claim 3 in which said primary element is a venturi.

7. The method of maintaining a known and substantially constant BTU throughout through a rotary drum which is heated by steam, which steam is supplied to said roller through a supply pipe and from which a mixture of steam and condensate is withdrawn through a drain pipe, there being a steam supply flow meter in said supply pipe and a drain flow meter in said drain line, and there being an adjustable valve in each of said pipes, said method comprising:

a. with said flow meters measuring the flow of fluid through the respective flow meter;

b. compensating by calculation the offset from the measurement of the drain flow meter to account for the condensate so as to determine the flow of steam therethrough:

c. determining from the difference in steam flow as determined by steps a and b, above, the BTU supplied to the roller; and d. adjusting at least one of said valves to maintain a desired BTU throughout.

* * * * *